United States Patent [19]

Deborde

[11] 4,256,147

[45] Mar. 17, 1981

[54] WEAVING LOOM

[75] Inventor: Albert H. Déborde, Bourgoin-Jailleu, France

[73] Assignee: Saurer - Diederichs Société Anonyme, Bourgoin-Jailleu, France

[21] Appl. No.: 59,146

[22] Filed: Jul. 20, 1979

[30] Foreign Application Priority Data

Jul. 24, 1978 [FR] France ..... 78 22882

[51] Int. Cl.[3] ..... D03D 49/12

[52] U.S. Cl. ..... 139/115

[58] Field of Search ..... 139/114, 115, 109, 110, 139/100

[56] References Cited

U.S. PATENT DOCUMENTS

| | | | |
|---|---|---|---|
| 2,551,920 | 5/1951 | Willis | 139/97 |
| 3,495,631 | 2/1970 | Sakamoto | 139/115 |
| 3,860,044 | 1/1975 | Mizuno | 139/109 |

FOREIGN PATENT DOCUMENTS

| | | | |
|---|---|---|---|
| 1710239 | 6/1975 | Fed. Rep. of Germany | 139/115 |
| 2710903 | 9/1978 | Fed. Rep. of Germany | 139/114 |
| 48-23108 | 7/1973 | Japan | 139/110 |
| 475391 | 8/1969 | Switzerland | 139/115 |

*Primary Examiner*—Henry Jaudon

*Attorney, Agent, or Firm*—Karl F. Ross

[57] ABSTRACT

A weaving loom is equipped with a system for controlling oscillation of a warp yarn support roller in which a first rotary cam actuates an oscillating first lever connected to a first arm integral with a first shaft on which the roller is mounted. The first shaft rests, through the intermediary of raising members, in bearings supported by second levers pivoting about a fixed pivot and connected, through the intermediary of pivoted connecting rods, to the third and fourth levers which are keyed to a second shaft and subject to urging by at least one spring. The system includes a fifth lever keyed to the second shaft and a second rotary cam actuating an oscillating sixth lever pivotably connected to a second arm which is alongside the fifth lever and is freely mounted on the second shaft. A fixed first hook is mounted on the second arm and a pivotable second hook is mounted on the fifth lever. An electromagnet holds the second hook clear of the first hook except when the loom is being started. In this event the second cam causes the second arm to pivot downwards about the second shaft so that the first hook pushes the second hook downwards causing the fifth lever to pivot downwards and rotate the second shaft. This rotation throws the connecting rods which pivot the second levers which move the support roller transversely to warp yarn passing thereover to increase tension in the yarn.

8 Claims, 4 Drawing Figures

WEAVING LOOM

Field of the Invention

This invention relates to a weaving loom provided with a device to eliminate differences in the warp yarn characteristics at the time of starting-up the loom.

BACKGROUND OF THE INVENTION

A loom can be provided with a system for controlling the oscillation of a yarn support roller comprising, on at least one side of the loom, a rotary cam actuating an oscillating lever connected to an arm integral with the shaft of the yarn support roller. This shaft rest, through the intermediary of raising members, in bearings supported by levers pivoted about a fixed pivot point and is connected, through the intermediary of a connecting rod, to another lever keyed on a shaft subject to the action of at least one spring. When the loom is operated continuously, this known system makes it possible to cause the axis of the yarn support roller to oscillate, in order to absorb the alternating phenomenon of excess tension or slack of the warp yarns caused by the opening or closing movement of the two sheds in the weaving process, this slack take up taking place while ensuring tensioning of the yarn by virtue of the spring.

However, at the time of re-starting the loom after a stoppage, the system in question does not make it possible to eliminate differences in the warp, i.e. differences in the number of warp threads per unit length, which create defects in the fabric, which defects are well-known to persons skilled in the art and are known as "thin spots", "marks" or "flaws". No device currently exists for preventing these defects, in high speed looms.

OBJECTS OF THE INVENTION

It is the object of the present invention to obviate this shortcoming.

SUMMARY OF THE INVENTION

According to the invention there is provided a weaving loom having a system for controlling oscillation of a warp yarn support roller comprising, on at least one side of the loom, a rotary first cam mounted on a first shaft acutating an oscillating first lever connected to an arm integral with a second shaft. The yarn support roller is mounted on a second shaft resting, through the intermediary of a raising member in a bearing supported by a second lever pivoted about a fixed pivot and connected through the intermediary of a connecting rod to a third lever keyed to a third shaft subject to the action of at least one spring.

The system including a device for preventing differences in warp yarn at the time of starting up the loom.

This device comprises a second rotary cam mounted on the first shaft and actuating an oscillating fourth lever connected to a pivoted arrangement, a fifth lever keyed to the third shaft subject to the action of the spring, hooking means controlled by an electromagnet being provided so that said fifth lever is entrained at the same time as an element of the pivoted arrangement upon starting up the loom. The said connecting rod changes the position of the bearing for the oscillation of the second shaft carrying the yarn support roller in a direction corresponding to additional tension on the warp yarn.

Thus, the device, in a loom formed according to the invention, is attached to the system for the oscillation of the yarn support roller and at the time of starting-up the loom, creates an additional movement of the second shaft carrying said roller which, by applying greater tension to the warp yarns, prevents differences in the weft.

The device may be provided either on only one side of the loom, or on both sides of the loom. In the first case, the fact that the third shaft on which the fifth lever is keyed, passes through the entire loom, allows the single device to move the second shaft by its two ends.

In a preferred embodiment the pivoted arrangement comprises a pulling rod pivotably connected to the oscillating fourth lever and to one end of said element comprised by an oscillating second arm. The other end of said second arm is freely rotatable about the third shaft and the hooking means comprises first and second hooks, the first hook being mounted on said second arm while is stationary relative thereto, and the second hook is mounted on the fifth lever and is pivotable relatively to said fifth lever which also supports the electromagnet. Depending on whether the latter is or is not supplied with current, the trajectory of one of the hooks encounters or does not encounter the other hook which makes it possible, by means of an adequate control of the supply of power to the electromagnet, to obtain hooking at the time of starting-up, in order to set the fifth lever in rotation, this hooking being initiated as soon as the loom is stopped.

Advantageously, the oscillating second arm is pivoted to a stirrup member mounted to slide on the pulling rod but normally bearing, under the effect of resilient means, against an adjustable stop supported by the pulling rod. The possibility of adjusting the device is thus provided and furthermore, the resilient means which may be, for example, in the form of a stack of elastically yieldable washers ensures a damping and safety function, thus preventing the direct connection between the pulling rod and the oscillating second arm.

The invention will now be further described, by way of example, with reference to the accompanying drawing in which.

SPECIFIC DESCRIPTION

Figure 1:
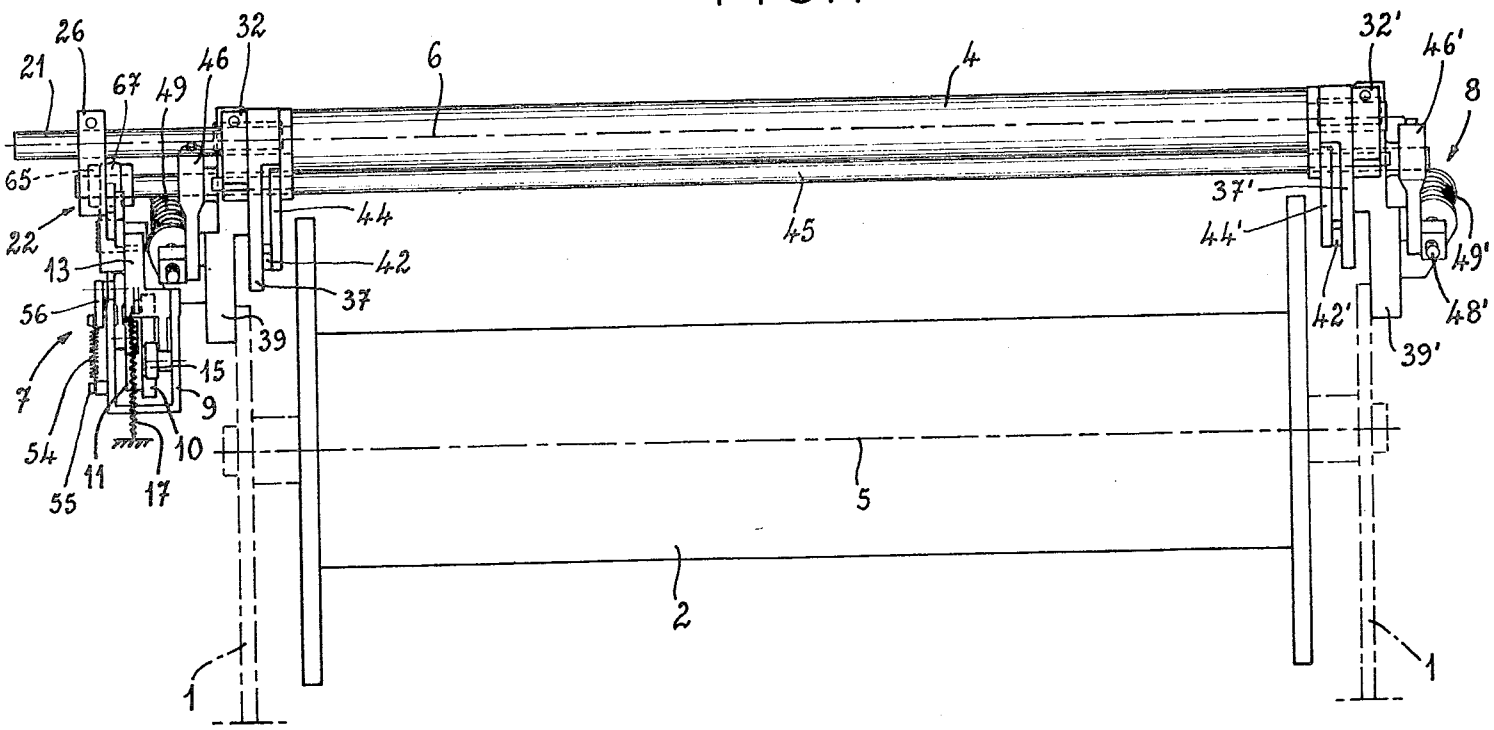
FIG. 1 is a fragmentary rear elevational view of a weaving loom according to the invention.

The drawing shows, very diagrammatically, a frame 1 of a loom as well as a beam 2 from which warp threads 3 unwind and a yarn support roller 4 over which the warp threads 3 pass, before forming a substantially horizontal shed which then divides into two sheds 3*a* and 3*b*. The beam 2 and the roller 4 rotate about horizontal and parallel axes respectively 5 and 6, located in the rear part of the loom.

The complete system in question is composed of two mechanisms 7 and 8, located respectively on the two sides of the loom, in the vicinity of the ends of the beam 2 and of the yarn support roller 4. These two mechanisms, which have similar parts but are not identical, are illustrated respectively in FIGS. 2 and 3.

Figure 2:
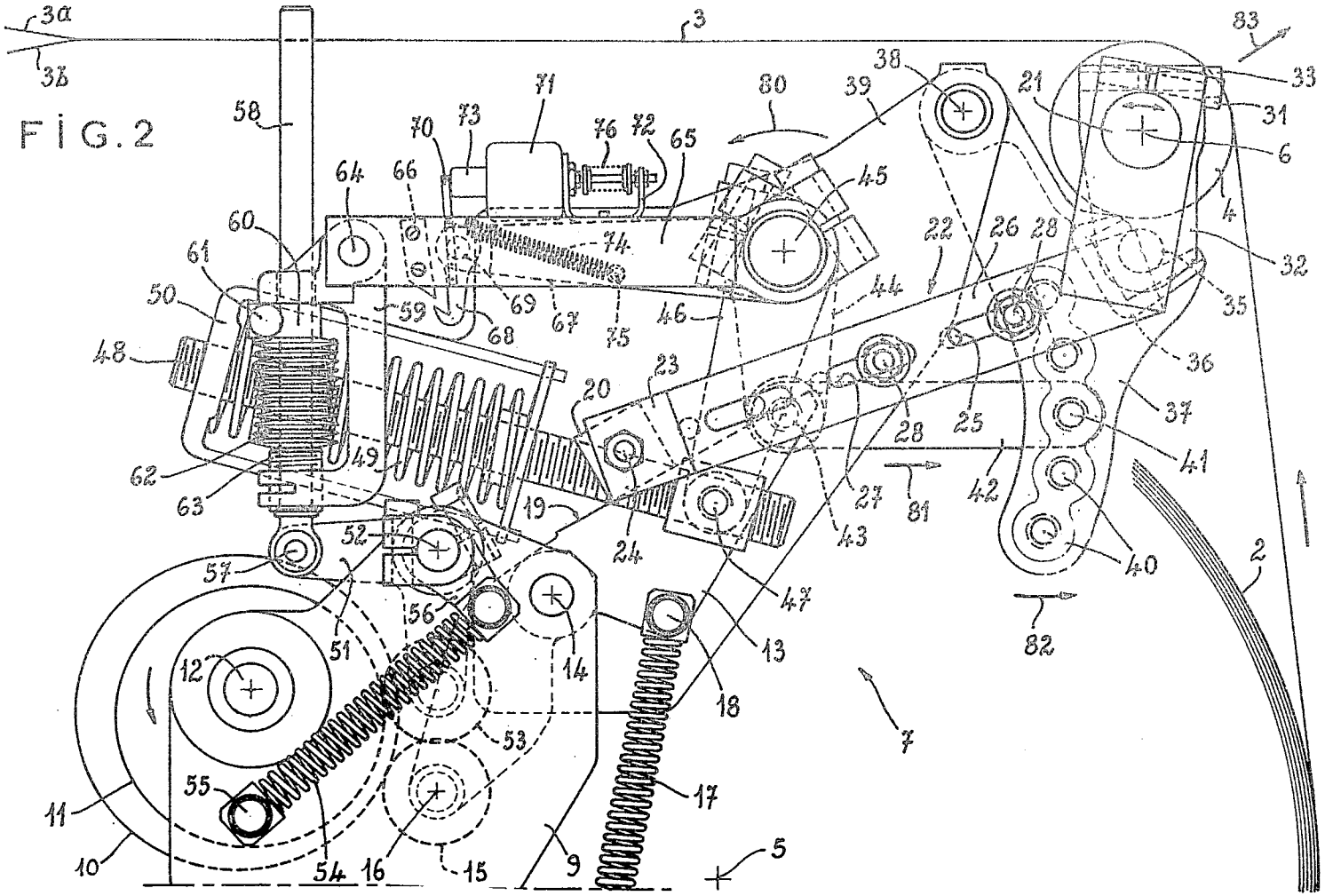
FIG. 2 is a side elevational view showing on an enlarged scale, part of the system located on one side of the loom in FIG. 1.

The mechanism 7, which is visible in FIG. 2, comprises a case 9, integral with the frame 1 of the loom, inside which are mounted two rotary cams 10 and 11, keyed on the same shaft 12 parallel to the axes 5 and 6.

At the time of continuous operation, the first cam 10 makes it possible to control the oscillation of the yarn support roller 4, this being through the intermediary of an oscillating lever 13. This lever is pivoted to the casing 9 about an intermediate fixed pivot 14. A roller 15, mounted to rotate freely about a shaft 16 located at one end of the lever 13, travels along the profile of the cam 10. A spring 17, stretched between a point 18 of the lever 13 and a fixed point which is not shown in FIG. 2, permanently presses the roller 15 against the cam 10. At its opposite end to the roller 15, the lever 13 comprises a flat surface 19 directed upwards, against which a block 20 of a material having a low coefficient of friction is pressed and is able to slide.

The said block 20 is connected to the shaft 21 of the yarn support roller 4 through the intermediary of an arm 22 of adjustable length, formed by the comination of two parts. The first of these parts 23 is a straight flat bar, at one end of which the block 20 is mounted to pivot and retained by means of a screw/nut arrangement 24. Over its entire length, this flat bar comprises tapped holes 25 at regular intervals. The second part 26 of the arm 22 has a cranked shape. One of its sides is provided with slots 27. Screws 28, passing through these openings 27, are screwed into the holes 25 in the part 23 and connect the latter to the part 26, whilst allowing the length to be adjusted. The part 23 and the side in question of the part 26 are thus connected one as an extension of the other. The other side of the part 26, located beyond the crank in the latter, is directed upwards and at its upper end is secured by gripping to the shaft 21 of the yarn support roller 4, by means of a screw 31, in order to prevent any rotation of this shaft 21 with respect to the part 26.

Fixed on the shaft 21, at some distance from the part 26, is a raising member 32 which itself is also prevented from rotating with respect to the shaft by means of a clamping screw 33. In its lower part, the raising member 32 supports a small shaft 35 able to oscillate in a bearing 36, which is supported by a lever 37 of general concave shape.

This lever 37 is pivoted by its upper end about a pivot 38, on a support 39 integral with the frame 1 of the loom. In its lower half, the lever 37 comprises a plurality of holes 40, passing through one of which is a pivot pin 41 about which an end of a connecting rod 42 is pivoted. The other end of the connecting rod 42 is pivoted about a pivot pin 43, to another lever 44 keyed on a shaft 45, which is mounted to rotate in the support 39 and passes through the entire loom.

In the vicinity of the lever 44, the shaft 45 supports another lever 46, the end of which is pivoted about a pivot pin 47, to a screw-threaded rod 48 which is subject to the thrust of a large spring 49, which bears on a part 50 projecting from the support 39.

Figure 3:
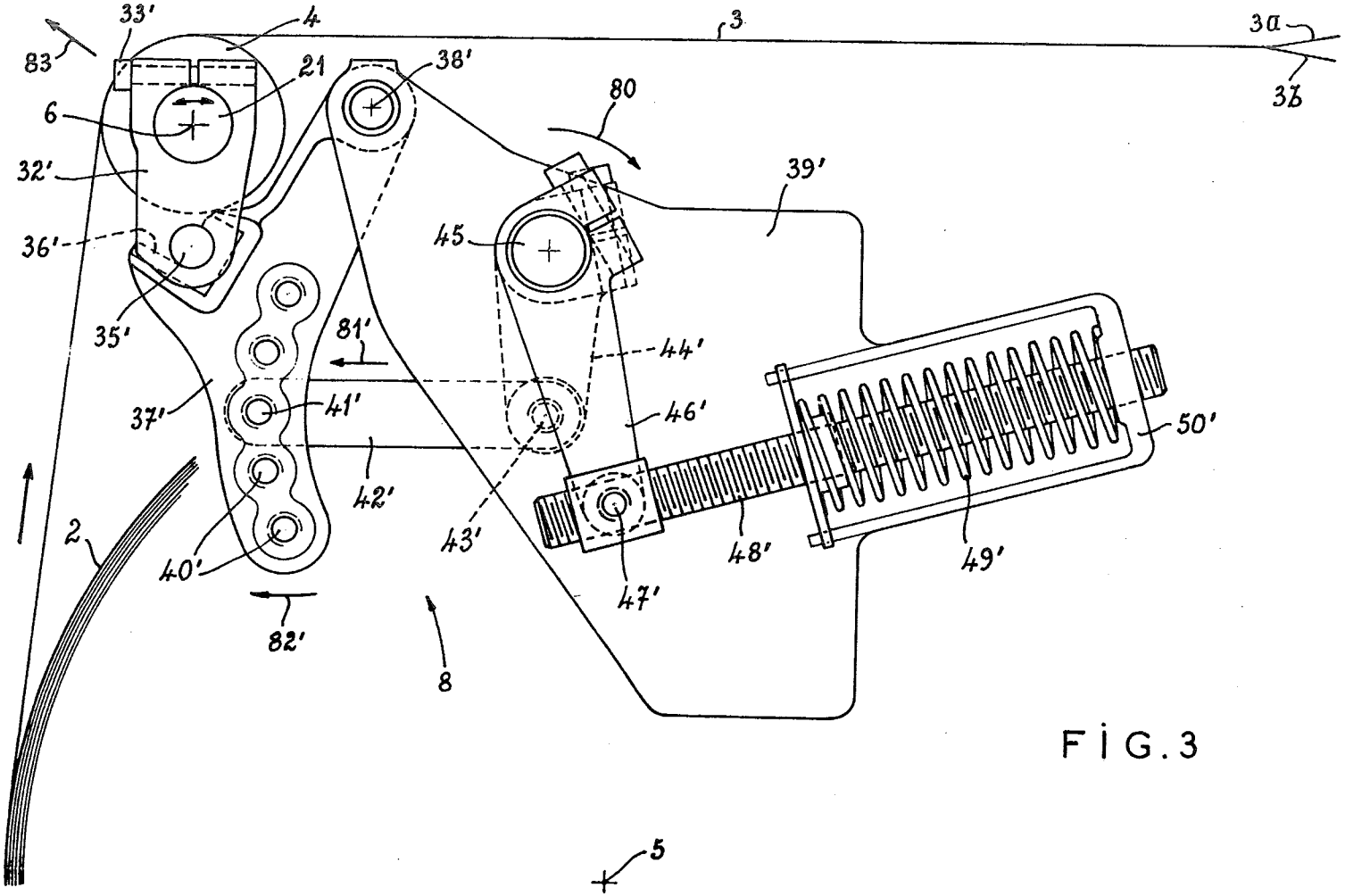
FIG. 3 is another side elevational view which shows on an enlarged scale, the part of the system in FIG. 1 located on the opposite side to that shown in FIG. 2.

Part of the afore-described members also exist in the mechanism 8 located on the other side of the loom and shown in FIG. 3. A support 39′, similar to the support 39, facilitates the pivoting of a lever 37′, which is symmetrical with respect to the lever 37, about a pivot pin 38′. The lever 37′ supports a bearing 36′ on which a shaft 35′ supported by a raising member 32′ is able to oscillate. The raising member 32′ is connected to rotate with the shaft 21 of the yarn support roller 4, in the same manner as the raising member 32 located on the other side, by means of a clamping screw 33′. A connecting rod 42′ is also provided, one end of which is pivoted to the lever 37′, about a pivot pin 41′ corresponding to a hole 40′ in the said lever and the other end of which is pivoted to another lever 44′ about a pivot pin 43′. Like the lever 44, the lever 44′ is keyed on the shaft 45 which, passing through the loom, is also mounted to rotate in the support 39′. Finally, a last lever 46′, also keyed on the shaft 45, is pivoted about a pivot pin 47′, to a screw-threaded rod 48′ subject to the thrust of a large spring 49′ which bears on a projecting part 50′ of the support 39′. On the other hand, on this side in question, neither cams nor members corresponding to the lever 13 and to the arm 22 located on the other side of the machine, are provided.

The device to which the present invention relates specifically is associated with the single mechanism 7 located on one side of the loom and illustrated in FIG. 2. This device, also illustrated separately in FIG. 4, comprises a cranked lever 51, pivoted to the casing 9 about a fixed pivot 52 located in the region of its crank. A roller 53 is mounted to rotate freely at the end of one of the two sides of the lever 51 and it travels along the profile of the second cam 11. A spring 54, stretched between a fixed point 55 located on the side of the casing 9 and a sleeve 56 connected in a rotary manner to the cranked lever 51, permanently presses the roller 53 against the cam 11.

The end of the second side of the cranked lever 51 is pivoted, about a pivot pin 57, to the lower end of a substantially vertical pulling rod 58, which supports a stirrup member 59. The latter is mounted to slide on the rod 58 but it normally bears against a stop 60 fixed by gripping in an adjustable position on the rod 58, by means of a screw 61. A stack of elastically yieldable washers 62 is placed around the rod 58 between the stop 60 and the socket 63 connected to one end of the stirrup member 59, in order to press the other end of the stirrup member against the stop 60.

Figure 4:
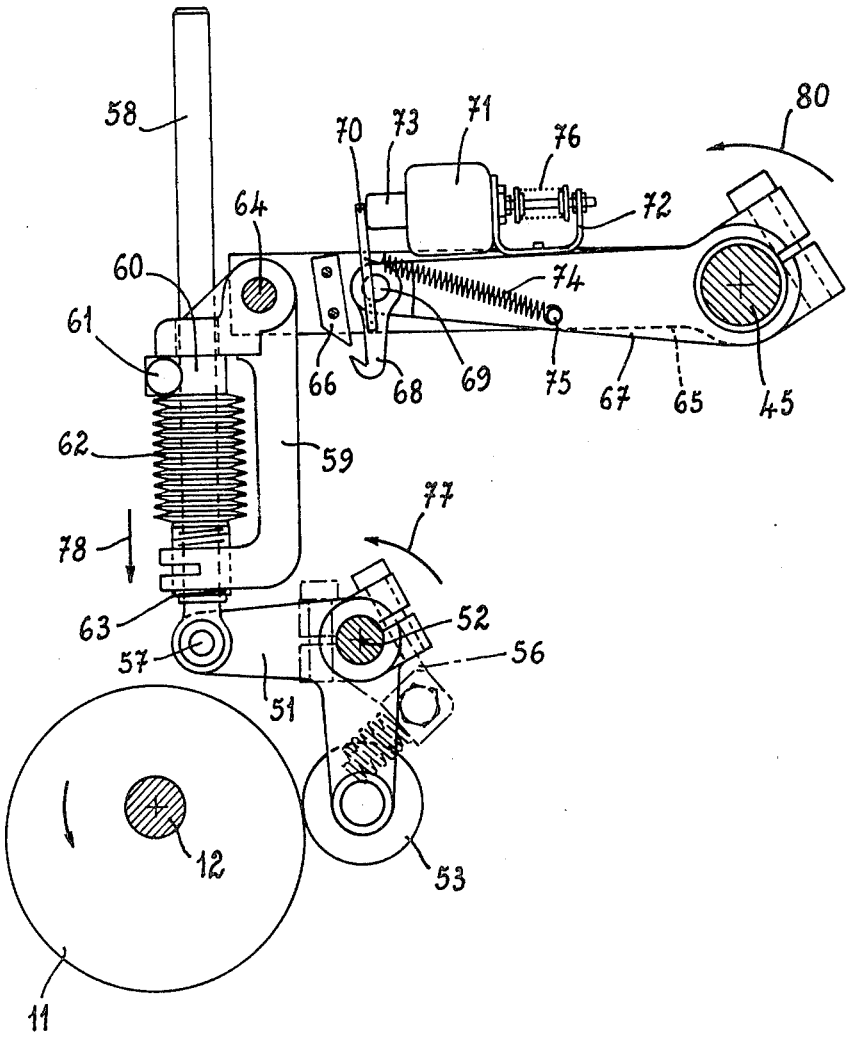
FIG. 4 is a detail view of a fragment of the device in the system in FIG. 2.

Pivoted to the upper part of the stirrup member 59, about a pivot 64, is one end of a double oscillating arm 65, the other end of which rotates freely about the shaft 45. The double oscillating arm 65 thus forms a type of substantially horizontal connecting rod, comprising a recess at its centre, FIG. 4 showing this connecting rod with its front part removed in order to reveal the elements located between the front part and the rear part, in the central recess.

On the one hand, these internal elements comprise a "fixed" hook 66 connected by two secrews to the double arm 65, in the vicinity of the pivot 64 for the stirrup member 59 and on the other hand, a lever 67 keyed on the shaft 45. Mounted at the free end of the lever 67, located in the vicinity of the fixed hook 66, is a "movable" hook 68, which is able to pivot about a pivot pin 69 with respect to the end of the lever 67. The movable hook 68 comprises a control finger 70 and it can be actuated by means of an electromagnet 71, fixed by means of a U-shaped support 72 to the upper side of the lever 67. When the electromagnet 71 is excited, its movable core 73 is attracted and it retracts, allowing the movable hook 68 to pivot in clockwise direction, with reference to FIG. 2 or 4, under the action of a control spring 74 stretched between the finger 70 and a point 75 located on the side of the lever 67. When the electromagnet 71 is not excited, its movable core 73 emerges, under the thrust of a spring 76 and it pushes the control finger 70 of the movable hook 68 in order to pivot the latter in counter-clockwise direction, against the pulling force exerted by the spring 74 (the effect of the srping 76 prevailing over that of the spring 74).

At the time of continuous operation, the rotation of the first cam 10 causes the oscillation of the lever 13 about its pivot 14. This oscillation movement causes an alternating movement of the arm 22, the block 20 sliding, in the manner of a shoe, on the surface 19 of the lever 13. This results in an oscillating movement, on the bearings 36 and 36', of the rigid arrangement constituted by the arm 22, the shaft 21 of the yarn support roller 4 and the two raising members 32 and 32'. The axis of oscillation of this arrangement during continuous operation is fixed. In fact, the electromagnet 71 remains non-excited, so that, despite the permanent oscillation of the double arm 65 controlled by the second cam 11, the movable hook 68 does not co-operate with the fixed hook 66, the trajectory of the hook 66 not encountering the hook 68. Thus, the lever 67 retains a position independent of that of the double arm 65. The rigid arrangement formed by this lever 67, the shaft 45, the two levers 46 and 46' and the two levers 44 and 44' thus occupy the position determined solely by the thrust of the two springs 49 and 49'. As a result of the connection achieved with this arrangement by means of the connecting rods 42 and 42', the two levers 37 and 37', supporting the respective bearings 36 and 36', remain stationary and define a fixed oscillation axis for the shaft 21 of the yarn support roller 4.

Although at the time of continuous operation, the mechanism controlled by the cam 11 does not intervene, one should understand that this cam causes a permanent oscillation of the double arm 65. Thus, at the time when the larger diameter part of the cam 11 co-operates with the roller 53, the cranked lever 51 pivots in the direction indicated by arrow 77 and it pulls the rod 58 downwards in the direction of arrow 78 (c.f. FIG. 4). The rod 58 pulls the stirrup member 59 downwards, as well as the end of the double arm 65 pivoted to said stirrup member. The double arm 65 thus pivots downwardly about the shaft 45. At the time when the loom is stopped, by actuating the braking system of the latter, the electromagnet 71 is excited simultaneously, so that the movable hook 68 is moved to a position in which the trajectory of the hook 66 encounters this hook 68. Consequently, during its last descending movement before the loom is stopped, the fixed hook 66 co-operates with the movable hook 68. Thus, the lever 67 will be forced to follow the pivotal movement of the double arm 65, so that the rigid arrangement formed by this lever 67, the shaft 45 and the levers 44, 44', 46 and 46' tends to pivot, in the direction indicated by arrow 80.

At the time of re-starting the loom, the electromagnet 71 is de-energised, but the two hooks 66 and 68 remain temporarily hooked to each other, so that the action on the shaft 45 previously initiated and described above, is maintained. Thus, the movement of the two levers 44 and 44' causes the two connecting rods 42 and 42' pivoted thereto, to move forwards, in the direction of the respective arrows 81 and 81' (c.f. FIGS. 2 and 4). The two levers 37 and 37', supporting the bearings 36 and 36', thus pivot in the direction of the respective arrows 82 and 82' about pivots 38 and 38', so that the yarn support roller 4 is pushed in the direction of arrow 83 and causes the desired effect, namely producing additional tension on the warp threads 3 which prevents differences in the weft at the time of starting-up.

As the first operating cycle of the loom continues, at a given instant, the hook 66 arrives in a position higher than the hook 68, so that the latter is automatically released and resumes its initial position under the force of the spring 76, transmitted by the core 73 of the electromagnet. The entire device thus operates continuously, as described above.

It should be noted that the special structure of the pulling rod 58 and of the stirrup member 59 allows double adjustment and ensures a damping and safety function, for the correct operation of the device according to the invention. By moving the adjustable stop 60 along the rod 58, the mean position of the double oscillating arm 65 is adjusted. By screwing the socket 63, which has an external screw-thread, to a greater or lesser extent into the stirrup member 59, the compression of the elastically yieldable washers 62 is adjusted. The latter ensure the damping and safety function, by being compressed if the stirrup member 59 encounters a certain resistance preventing it from following the movement of the pulling rod 58.

The device eliminating differences in the warp at the time of starting-up, can be applied to looms of all types, both conventional looms as well as shuttleless looms.

What is claimed is:

1. A weaving loom provided with a system for controlling oscillation of a warp yarn support roller, said system comprising on at least one side of the loom, a rotary first cam mounted on a first shaft, said first cam actuating an oscillating first lever connected to an arm integral with a second shaft, the yarn support roller being mounted on said second shaft resting, through the intermediary of a raising member, in a bearing supported by a second lever pivoted about a fixed pivot and connected through the intermediary of a connecting rod to a third lever keyed to a third shaft subject to the action of at least one spring, said system including a device for preventing differences in warp yarn at the time of starting-up the loom, and said device comprising a second rotary cam mounted on the first shaft and actuating an oscillating fourth lever connected to a pivoted arrangement, a fifth lever being keyed to the third shaft subject to the action of said spring, hooking means controlled by an electromagnet being provided so that said fifth lever is entrained at the same time as an element of the pivoted arrangement upon starting up the loom, and by means of the said connecting rod changes the position of the bearing for the oscillation of the second shaft carrying the yarn support roller, in a direction corresponding to additional tension on the warp yarn.

2. A weaving loom as defined in claim 1 in which the said pivoted arrangement comprises a pulling rod pivotably connected to the oscillating fourth lever and to one end of said element comprised by an oscillating second arm, the other end of said second arm is freely rotatable about the third shaft, the hooking means comprises first and second hooks, the first hook is mounted on said second arm and is stationary relative thereto, and the second hook is mounted on the fifth lever and is pivotable relatively to said fifth lever which also supports the electromagnet.

3. A weaving loom as defined in claim 2, in which the oscillating second arm is double, and the fifth lever supporting the pivotable second hook is located in a central recess in the double second arm.

4. A weaving loom as defined in claim 2 or claim 3, in which said oscillating second arm is pivoted to a stirrup member mounted to slide on the pulling rod but normally bearing, under the effect of resilient means, against an adjustable stop supported by the pulling rod.

5. A weaving loom as defined in claim 4 in which said resilient means comprises a stack of elastically yieldable washers placed around the pulling rod, between the adjustable stop and a socket connected to the stirrup member.

6. A weaving loom as defined in claim 5 in which the said socket has an external screw-thread and can be screwed to a greater or lesser extent into the stirrup member.

7. A weaving loom as defined in claim 1, in which the device is provided on only one side of the loom, and the third shaft passes through the entire loom and allows the device to move the second shaft by its two ends.

8. A weaving loom as defined in claim 1, in which the device is provided on both sides of the loom.

* * * * *